United States Patent [19]

Washburn

[11] Patent Number: 4,494,805

[45] Date of Patent: Jan. 22, 1985

[54] EQUIPMENT LOCKER

[75] Inventor: Philip J. Washburn, Roseburg, Oreg.

[73] Assignee: Glen E. Beymer, Creswell, Oreg.

[21] Appl. No.: 445,357

[22] Filed: Nov. 29, 1982

[51] Int. Cl.[3] ..... A47B 81/00

[52] U.S. Cl. ..... 312/215; 70/279; 200/318; 211/60 SK; 292/201; 312/100

[58] Field of Search ..... 211/60 SK; 312/100, 312/215; 292/201; 49/29, 386; 200/329, 340, 318; 70/279, 280, 281, 282, 417

[56] References Cited

U.S. PATENT DOCUMENTS

| | | | |
|---|---|---|---|
| 122,615 | 1/1872 | Knight | 49/386 |
| 455,126 | 6/1891 | Smith et al. | 292/201 |
| 767,298 | 8/1904 | Louis | 292/201 |
| 1,189,760 | 7/1916 | Weiskopf | 292/201 |
| 1,864,474 | 6/1932 | Rosenbaum | 70/279 |
| 1,940,027 | 12/1933 | Smith | 292/201 |
| 2,045,186 | 6/1936 | Honsel | 70/279 |
| 2,171,365 | 8/1939 | Harding | 292/201 |
| 2,469,283 | 5/1949 | Steele | 292/201 |
| 2,543,214 | 2/1951 | Wildberg | 292/201 |
| 2,963,165 | 12/1960 | Steiner | 211/60 SK |
| 3,543,547 | 12/1970 | Sugiyama | 292/201 |
| 3,604,228 | 9/1971 | Conlon | 211/60 SK |
| 3,848,785 | 11/1974 | Bott | 211/60 SK |
| 3,953,991 | 5/1976 | Grossman | 70/279 |
| 4,122,631 | 10/1978 | Batcheller | 49/386 |

FOREIGN PATENT DOCUMENTS

| | | | |
|---|---|---|---|
| 2706330 | 8/1978 | Fed. Rep. of Germany | 211/60 SK |
| 2735999 | 2/1979 | Fed. Rep. of Germany | 292/201 |
| 2278293 | 7/1974 | France . | |
| 2414313 | 1/1978 | France | 211/60 SK |

*Primary Examiner*—William E. Lyddane
*Assistant Examiner*—Thomas A. Rendos
*Attorney, Agent, or Firm*—James D. Givnan, Jr.

[57] ABSTRACT

A ski locker building is disclosed having rows of lockers each configured to receive the mid-portion of a pair of skis so as to confine same against lengthwise removal. Recesses in upper and lower plate members of each locker receive a skier's laterally inserted skis and poles whereafter a locker door is closed to constitute a barrier to ski and pole removal. A door jamb is of tubular construction to house lock mechanisms serving adjacent locker doors. A plunger type switch acts on a door mounted plate to urge the door to an open position in those instances where a latching solenoid is rendered inoperable by a computer controlled circuit including a circuit interrupter to cause cycling of the solenoid.

4 Claims, 6 Drawing Figures

EQUIPMENT LOCKER

BACKGROUND OF THE INVENTION

The present invention concerns lockers for the temporary storage of equipment such as skis and ski poles.

Typically skiers leave their skis and poles in an unsecured manner when taking a respite from skiing. The equipment is often left standing in the snow or leaning against a rack or building.

A recognized and growing problem at ski resorts is the theft of skis. In view of skiing growing in popularity and the high cost of ski equipment the theft of ski equipment amounts to several millions of dollars each year.

Attempts to remedy the problem include the checking of skis with a resort attendant which incurs the drawbacks of adequate storage area within a resort building, manpower effort to operate the ski storage concession including the handling of money for ski storage, the difficulty in checking skis and retrieving same at peak use periods. Skiers typically are adverse to queueing up for the checking in and retrieving of skis.

Additional efforts to remedy the problem have resulted in mechanical, money actuated locking systems where the skier, on deposit of a certain sum, will have the use of a lockable rack. The problems of handling small change and keys with gloved or cold hands renders these types of racks impractical. The risk of key loss is also present.

Presently, it may be said the majority of skiers at a day use resort forsake the checking and lockable racks for one reason or another and simply leave their skis and poles unattended during breaks in their skiing activity which not infrequently results in the theft of same.

SUMMARY OF THE INVENTION

The present invention is embodied in a locker for the orderly storage of equipment and particularly equipment that protrudes from the locker in a captive manner.

The present locker has configured structural members to receive laterally inserted skis and poles whereafter the same are confined against removal by a locker door edge. The configuration of the equipment stored and the slotted configuration of locker members prevents axial removal of the equipment. Accordingly, by confining the more bulky portions of the equipment, i.e., in the case of ski equipment, the ski bindings and the pole baskets, the locker need not fully enclose the articles.

Important objectives include the provision of an equipment locker which readily receives stowed equipment to secure some against theft and maintains the equipment in an orderly manner to permit convenient and expeditious removal of same; the provision of a locker which includes retainers for engagement with the stored equipment to maintain same in an upright position until forcefully extracted from the locker; the provision of a locker which is unlockable until a signal is generated by a locker associated computer which functions upon receiving a payment and code number; the provision of a locker which emits an audible signal that indicates that an open locker is unavailable for storage purposes until payment has been made; the provision of a locker incorporating a combination spring biased plunger and switch to bias the locker door to an open position and to close a circuit to a door locking or latching solenoid; the provision of a locker having a lock supporting jamb which jamb is removably mounted to permit the custodian of the locker to rapidly replace a malfunctioning lock or locks by replacement of the jamb; the provision of a locker having a push button type switch which is operable to close, upon door closing, a circuit to a latch actuating solenoid so as to deactivate the latch upon door closing to prevent unauthorized use of the locker.

DETAILED DESCRIPTION OF THE PREFERRED EMBODIMENT

Figure 1:
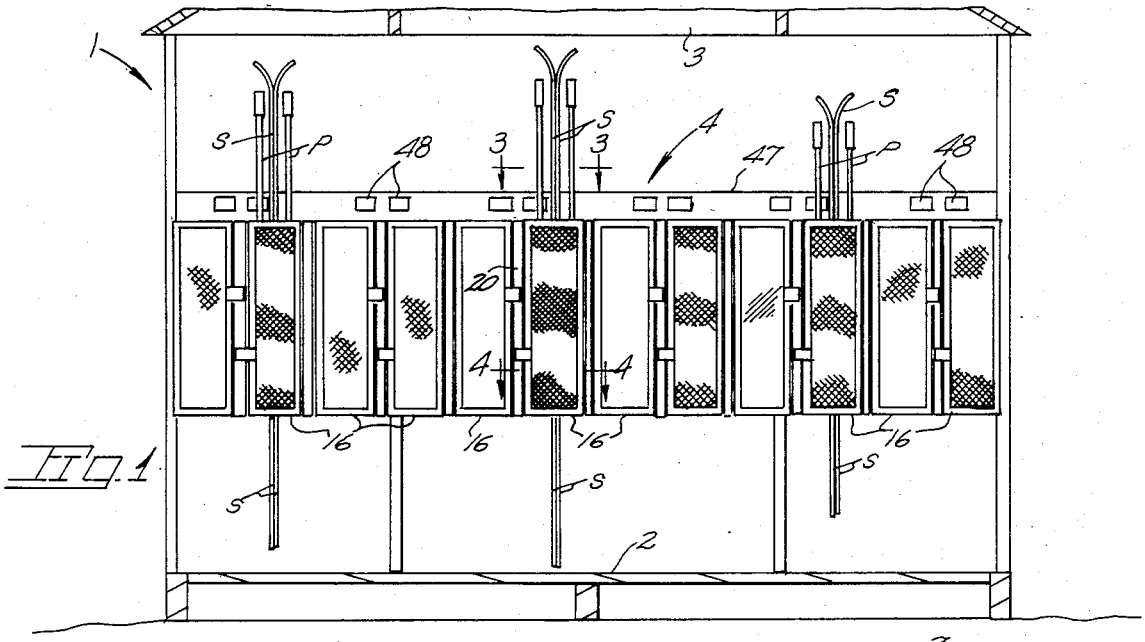
FIG. 1 is a front elevational view of a row of lockers made in accordance with the present invention.
Figure 2:
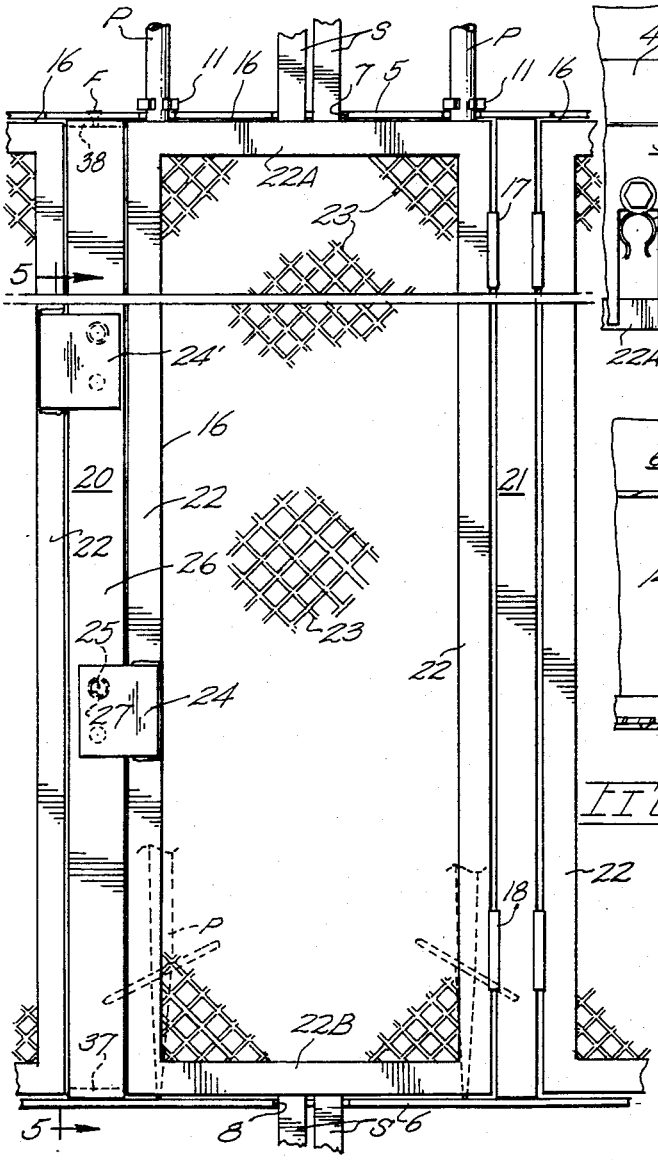
FIG. 2 is an enlarged front elevational view of one of said lockers sectioned for convenience of illustration.

With continuing attention to the drawings wherein applied reference numerals indicate parts hereinafter similarly identified, the reference numeral 1 indicates generally a building structure having a floor 2 and a roof structure 3. When intended for use at ski resorts, the present structure may be open sided and equipped with screw jacks to elevate the floor structure above ground level to the current level of the snow pack surface.

A typical row of lockers is indicated generally at 4 with the rows of lockers being spaced from an opposing row to define an aisle. The lockers, for space and materials economy, are arranged in back-to-back rows with a common back wall between two rows of lockers to provide locker islands each having two rows of lockers.

The building 1 may also house a computer system which renders the leasing of a locker to a user for a specific time period in an automated manner.

The lockers include an upper plate member 5 and a coterminous lower plate member 6 both being common to the rows of lockers. Said upper plate member defines inwardly extending, horizontal recesses 7 while lower plate member 6 defines like recesses 8 with the recesses in upright alignment with one another so as to receive a pair of juxtaposed skis S inserted laterally therein. Said plate members are spaced preferably about two and one-half feet apart so as to admit the mid-portion of the skis on which the ski bindings are mounted. The recesses 7 and 8 are of a width and depth to receive ski sections but are of a reduced width to inhibit passage of any binding component upwardly or downwardly therepast.

Upper member 5 defines additional recesses at 9 and 10 each adapted to receive a laterally inserted ski pole P with a spring clip at 11 and at 12 extending over the slot or recess to frictionally engage and hold the pole shaft. The pointed ski pole end rests upon the locker lower member.

A back wall at 13 serves in a dual manner for two back-to-back lockers while side walls at 14 and 15 serve to dente locker width with the side walls constituting common walls with adjacent side lockers.

A locker door at 16 is hingedly mounted at 17 and 18 to one side wall. The door is preferably disposed, when closed, interiorly of the locker perimeter which is constituted by the forward edges of the upper and lower plate members, a tubular door jamb at 20 and a side wall mounted door frame component 21. The door is shown with an angle iron frame or perimeter at 22 with an expanse of expanded metal at 23 secured thereto. Upper and lower door frame components at 22A,22B close off the plate recesses.

A lock mechanism for each door includes a door mounted plate as at 24 on which a bolt 25 is mounted. The plate overlies an outer wall 26 of the tubular door jamb with the bolt 25 being received with an opening 27 in the jamb wall. Door mounted plate 24 is recessed at 24A to abut the end of a plunger 28 of a push button type switch at 30. Internal contacts (not shown) of the switch serve to bridge external switch terminals at 31 and 32 upon spring biased plunger 28 being retracted by door plate contact. During normal door latching a door latch at 33 gravitationally engages notched bolt 25. The latch is elevated out of bolt engagement by a solenoid 34 having an armature 35 which is in the extended or locking configuration when said solenoid is de-energized as later explained. Similar lock mechanism components for an adjacent locker door are shown by prime reference numerals indicating parts analogous to those parts indicated by base reference numerals. Latch 33 is carried by a pivot pin 39 while solenoid 34 is movably mounted at one end by an eye carried by a pin 36 to permit manual release of the latch by a tool inserted through an opening 44.

Jamb 20 is held in place intermediate upper and lower locker members in a snug manner by tamper proof fasteners typically shown at F which engage jamb top and bottom end plates at 37 and 38 to secure the jamb in place yet permit removal of same by authorized persons for maintenance or replacement purposes.

Figure 5:
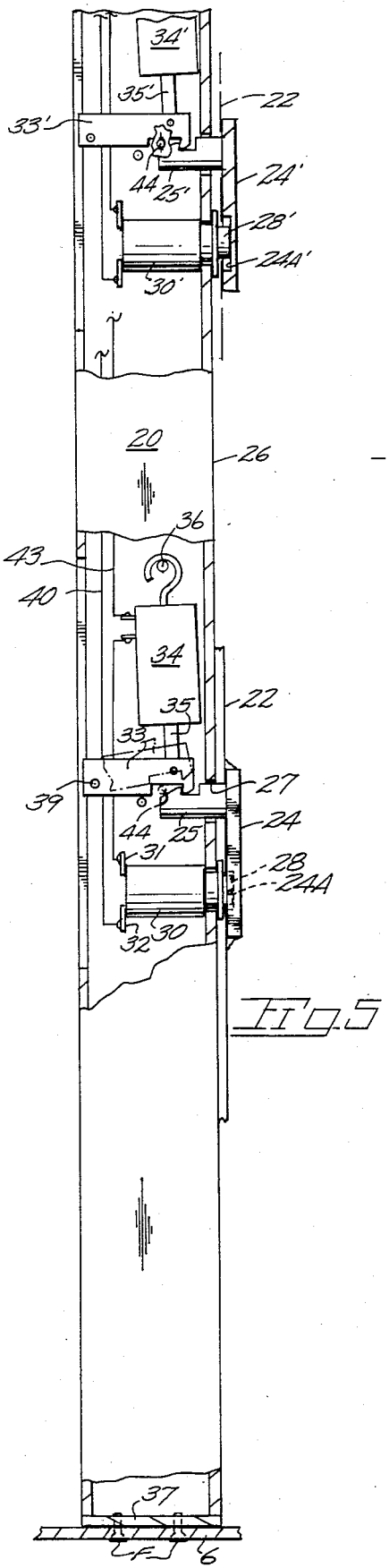
FIG. 5 is a vertical sectional view taken along line 5—5 of FIG. 2 showing a locker door jamb housing lock mechanisms.
Figure 6:
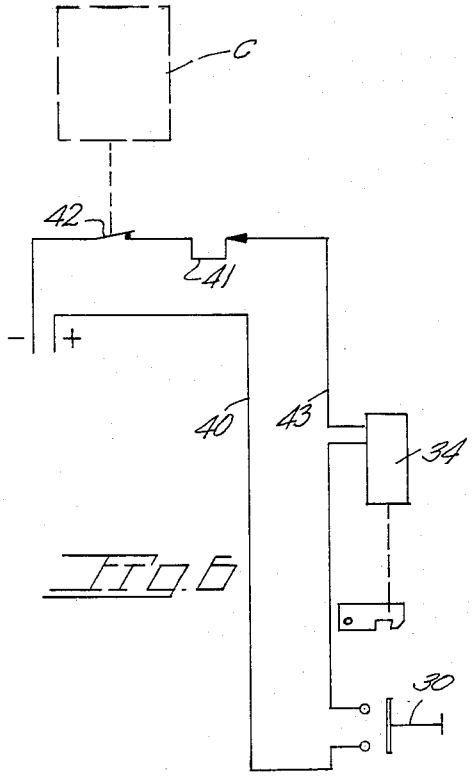
FIG. 6 is a schematic of a lock electrical circuit.

With attention to FIGS. 5 and 6 a solenoid actuating circuit includes a power source represented by line 40, push button switch 30, a ground line 43, solenoid 34, a self-interrupting switch 41 and a switch 42 actuated by a computer C. When door closure is attempted prior to computer operation, the closure of a door actuated switch 30 causes solenoid 34 to be cycled in rapid fashion to emit an audible clicking signal to notify the person that the intended locker is unavailable. Computer operation which entails the payment of a locker rental fee results in the opening of switch 42 to permit normal locking of the locker door. The spring biased switch 30 serves also to repel the door to an open or ajar position during repeated lifting of latch 33 by the signal generating cycling solenoid. Automatic door opening accordingly occurs upon timing out of the computor timer and closing of switch 42. It is assumed, of course, that the ski owner will have retrieved his equipment prior to such timing out and automatic door opening.

Figure 3:
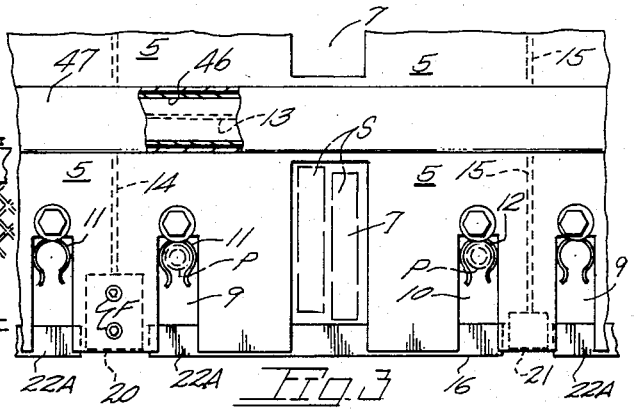
FIG. 3 is a view taken downwardly along line 3—3 of FIG. 1 showing a locker upper member.
Figure 4:
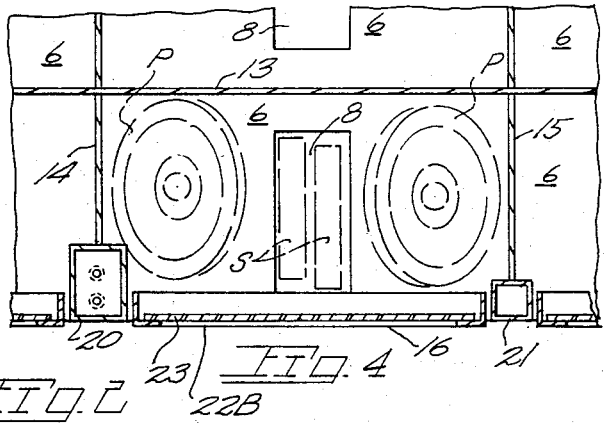
FIG. 4 is a horizontal sectional view taken downwardly along line 4—4 of FIG. 1 and showing a locker lower member.

For ease of wiring installation and maintenance, the electrical conductors 40 and 43 are routed along a channel structure 46 (FIG. 3) in place atop upper plate member 5 suitably closed by a cover plate 47. Said channel structure conveniently serves as a support for touch-type key pads 48 in circuit with the locker computer to enable locker opening from the locker proximity.

The use of self-interrupting switch 41 in the solenoid circuit results in rapid and audible cycling of the solenoid coil to impart successive impacts to the solenoid armature and hence latch 33 which has been found highly advantageous to actuate the latch in instances where latch movement is inhibited by ice or when the engaging surfaces of the latch and bolt are in heavily biased contact by reason of the locker door being biased outwardly by ski apparel compressed within the locker.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A locker for the orderly storage of ski equipment, said locker comprising, upper and lower members each having a horizontally extending open ended recess therein, side walls and a back wall extending intermediate said members, a door normally closing the open end of each recess and confining the stored articles therein to an upright position, said door additionally closing a storage area defined by said members and said side and back walls, a door jamb of tubular construction, a door locking mechanism within said door jamb, said locking mechanism including a solenoid having an armature, a door latch actuated by said armature, an electrical circuit serving said solenoid, a self-interrupting switch in said circuit causing the solenoid to be energized in an intermittent manner to impart impact loads to the latch to assure latch movement in the presence of loads on the door latch, a door actuated switch in said circuit and actuated to a closed position upon closing of the door, and a computer and a computer actuated switch closed by the computer at the expiration of a timed interval of locker use to close said electrical circuit and energize said solenoid and said self-interrupting switch.

2. The locker claimed in claim 1 wherein said door jamb defines an opening for the passage of an inserted hand tool, said latch and said solenoid being yieldably mounted in the door jamb to enable manual repositioning of the latch to disengage said latch from said door permitting opening of the latter in the event of an inoperable solenoid.

3. The locker claimed in claim 2 wherein said door includes a plate for striking abutment with said jamb and said door actuated switch is of the push button type to open the door upon unlocking of same.

4. The locker claimed in claim 2 wherein said door jamb includes a pin on which said solenoid is yieldably mounted in a depending manner.

* * * * *